United States Patent [19]

True et al.

[11] Patent Number: 4,737,680

[45] Date of Patent: Apr. 12, 1988

[54] GRIDDED ELECTRON GUN

[75] Inventors: Richard B. True, Santa Clara; Donald E. Laycock, Alameda, both of Calif.

[73] Assignee: Litton Systems, Inc., Woodland Hills, Calif.

[21] Appl. No.: 850,255

[22] Filed: Apr. 10, 1986

[51] Int. Cl.[4] ..... H01J 29/48; H01J 1/46; H01J 29/46

[52] U.S. Cl. ..... 313/349; 313/348; 313/447; 313/449; 315/3.5; 315/5.37; 315/14

[58] Field of Search ..... 313/348, 349, 448, 449, 313/454, 460; 315/14, 5.37

[56] References Cited

U.S. PATENT DOCUMENTS 3,962,656 6/1976 Peressini ..... 313/348 X
4,593,230 6/1986 True ..... 315/14

OTHER PUBLICATIONS

A Theory for Coupling Gridded Gun Design with PPM Focussing, by Richard True, IEEE, vol. ED-31, No. 3, Mar. 1984.

*Primary Examiner*—David K. Moore
*Assistant Examiner*—Mark R. Powell
*Attorney, Agent, or Firm*—Poms, Smith, Lande & Rose

[57] ABSTRACT

An improved grid arrangement is shown for a gridded electron gun wherein the control grid and/or shadow grid is provided with tapering grid vanes which reduce the amount of voltage required to cut off the electron beam. Alternately, a fewer number of grid vanes may be utilized to accomplish the same cutoff of the electron beam thus reducing the loading on the cathode and improving the transmission of the electron beam.

8 Claims, 2 Drawing Sheets

GRIDDED ELECTRON GUN

The present invention relates to an improved electron gun and, more particularly, to an improved grid configuration which makes it possible to quickly and sharply terminate the flow of electrons from the cathode toward the anode with a fewer number of grid vanes for the same cut-off voltage. Due to the reduced number of grid vanes, the cathode loading is reduced and the focusing and transmission of the electron beam is improved.

BACKGROUND OF INVENTION

A major number of electron guns of the Pierce type in use today are gridded to allow beam current control and on/off switching by grid voltage levels roughly two orders of magnitude less than the applied cathode-to-anode voltage. Such guns are used in various electron beam devices, such as microwave and millimeter-wave tubes, linear accelerators, and ubitrons or free electron lasers.

A paper describing gridded electron guns has been published by co-inventor Richard B. True, "A Theory For Coupling Gridded Gun Design With PPM Focussing," *IEEE Transactions On Electron Devices,* Vol. ED-32, NO. 3, March 1984, pp. 353. This paper presents theoretical and experimental methods for the design and optimization of a gridded Pierce electron gun.

In addition to this paper, the co-inventor of the present invention, R. B. True, has described an Improved Dual-Mode Electron Gun in U.S. Pat. No. 4,593,230, issued June 3, 1986, filed Mar. 29, 1982, assigned to the same assignee as this invention. This application discloses an improved shadow grid and control grid configuration which permits an electron gun to operate in a dual mode.

The grid configurations shown in the True article and the True U.S. Pat. No. 4,593,230 disclose a grid formed by a plurality of apertures placed within a thin conductive sheet, for example, wherein the material left between the apertures forms grid vanes having a uniform width. When these grids are used in an electron gun to terminate the flow of electrons from the cathode toward the anode, there is a requirement for a relatively dense number of grid vanes, or a relatively high cut-off voltage, to sufficiently terminate the electron flow.

SUMMARY OF INVENTION

Accordingly, it is an object of the present invention to provide an improved electron gun which permits a reduced cut-off voltage to terminate the flow of electrons from the cathode toward the anode.

Another object of this invention is to provide an improved electron gun which makes it possible to reduce the number of grid vanes within the grid itself, for a given cut-off voltage, while providing a quicker and sharper cutoff of the electron flow.

Still another object of the present invention is to provide a reduced number of grid vanes for a given cut-off voltage thereby reducing the cathode loading during operation.

A further object of this invention is to provide a reduced number of grid vanes for a given cut-off voltage which provides an improved flow of electrons as the electron beam is transmitted from the cathode toward the anode during operation, while providing a quicker and sharper cutoff of the electron flow when the operation is terminated.

In acomplishing these and other objects, there is provided an improved grid arrangement wherein the vanes that form the grid are arranged to permit such grid vanes to have a greater surface area at the outer periphery of the grid. This may be accomplished by tapering the grid vanes. That is, the grid vanes may be designed to taper from a narrow width at an inner radius toward a wider width at the outer radius. This tapered configuration can reduce the cut-off voltage by half. Conversely, the same cut-off voltage may be used with a reduced number of grid vanes. The reduced number of grid vanes has the effect of easing the cathode loading and, due to the reduced number of vanes, also improves the transmission of the electron beam. Further, the improved grid design makes the cutoff of the electron beam quicker and sharper.

DESCRIPTION OF THE DRAWINGS

Further objects and advantages of the present invention will become apparent to those skilled in the art after consideration of the following specification and accompaning drawings, wherein.

DESCRIPTION OF THE PREFERRED EMBODIMENT

Figure 1:
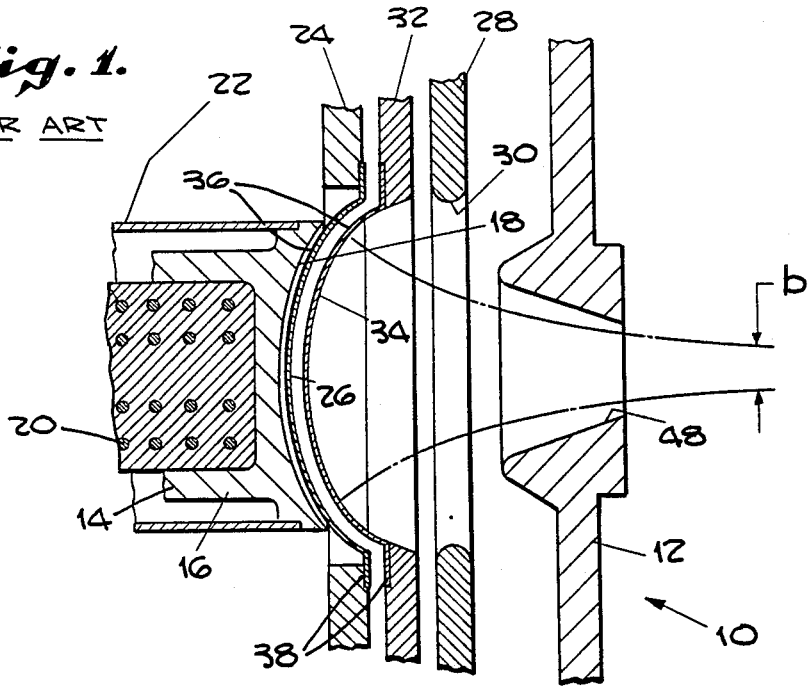
Fig. 1. PRIOR ART
FIG. 1 is a cross-sectional, schematic view of a prior art electron gun showing the environment in which the present invention is utilized.

Referring now to the drawings, FIG. 1 shows an electron gun 10 having an anode 12 and a cathode assembly 14. The cathode assembly 14 consists of a thermionic cathode dispenser 16 provided with a smooth, single-concaved electron emitting surface 18 which is heated by an encapsulated heating coil 20. The encapsulated heating coil 20 nests within a counterbored aperature in dispenser 16 that, in turn, mounts within a conductive sleeve 22 which fits snugly within a mounting housing, not shown.

Mounted adjacent to the cathode 16, upon the outer or right-hand surface of a housing ring 24, is a shadow grid 26 which may have the same spherical radius of curvature as the cathode 16. This grid may be manufactured by photoetching or electrical discharge machining a preformed, thin sheet of molybdenum, hafnium, or an alloy of copper and zirconium sold under the trade name of Amzirc. The shadow grid, in the preferred embodiment, may be 0.0015 inches thick.

A focusing electrode 28 having an annular opening 30 may be mounted between the cathode 16 and anode 12 within the housing, not shown. Mounted between the focusing electrode 28 and housing ring 24 is a second, housing ring 32 having a left-hand inner surface upon which is mounted a control grid 34. This control grid 34 may also have the same spherical radius of curvature as the cathode 16 and may be formed using materials and techniques similar to those used in formation of the shadow grid 26 as discussed above. The control grid 34 in the preferred embodiment may be 0.0025 inches thick.

Control grid 34 fits essentially concentrically within the spheroidally shaped shadow grid 26. Each of the grids is formed from a thin sheet of conductive material, as described above, which has been stamped or otherwise formed into a semi-spheroidal shape 36 having a grid flange 38. In each case, the shadow grid 26 or control grid 34 is mounted by the grid flange 38 to its respective housing ring 24 or 32.

Figure 2:
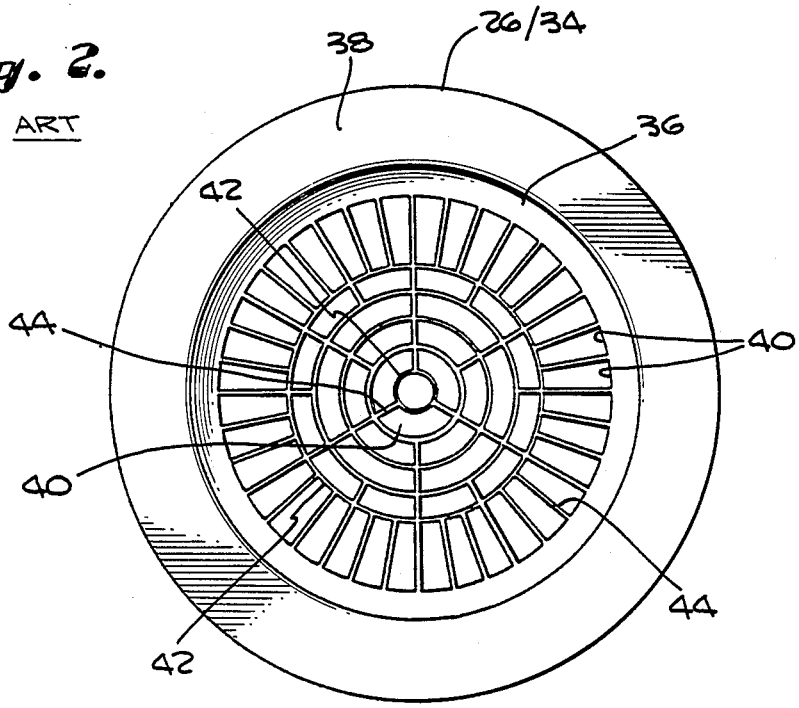
Fig. 2. PRIOR ART
FIG. 2 is a plan view of a prior art grid configuration.

As best seen in FIG. 2, a typical shadow grid or control grid labelled 26/34 is shown wherein the semi-spheroidal grid 36 is provided with a plurality of apertures or cells 40 having various shapes formed from circular conductive elements 42 and radiating conductive elements or grid vanes 44. It will be seen in FIG. 2 that the particular shadow/control grid shown includes an inner circular element 42 surrounded by three radiating grid vanes 44 to form three cells 40. The next set of cells includes six cells followed by a second set of six cells, a third set of 12 cells, and a final set of 36 cells. In the prior art, these cells are formed with the grid rings 42 and vanes 44 having a constant width of typically 0.002 inches. It will be understood that the grids may be constructed by arranging the conductive grid rings 42 and vanes 44 into any particular pattern. It will also be understood that in a typical electron gun the shadow grid 26 is arranged between the cathode 16 and the control grid 34 to prevent the electrons emitted from the surface 18 of cathode 16 from striking the control grid 34 and thereby overheating that grid. Thus, in most embodiments, the pattern of the shadow grid 26 and the control grid 34 is identical. However, this is not necessary within the teachings of this invention. The control grid 34 could have fewer or more vanes, for example. Further, this invention should not be limited to a combination of a shadow grid 26 and a single control grid 34, as more than one control grid is often utilized.

In the present invention, it was desired to find a design which would permit a quick and sharp cutoff of the flow of electrons from the cathode to the anode. Investigation disclosed that the outer peripheral area of the cathode was the last electron emitting area to be cut off when a cut-off voltage was applied to the control grid 34. This lead to the unexpected discovery that, by simply increasing the surface area of the control grid in the outer peripheral areas, the cut-off voltage could be reduced. The increased surface area in the outer peripheral area of the control grid also permitted the sharp, quick cutoff of electron flow which was desired.

The increased peripheral surface area of the control grid 34 may be accomplished by forming the grid vanes with various shapes, such as: a tapered vane, a stepped vane, or a curved vane.

Figure 3:
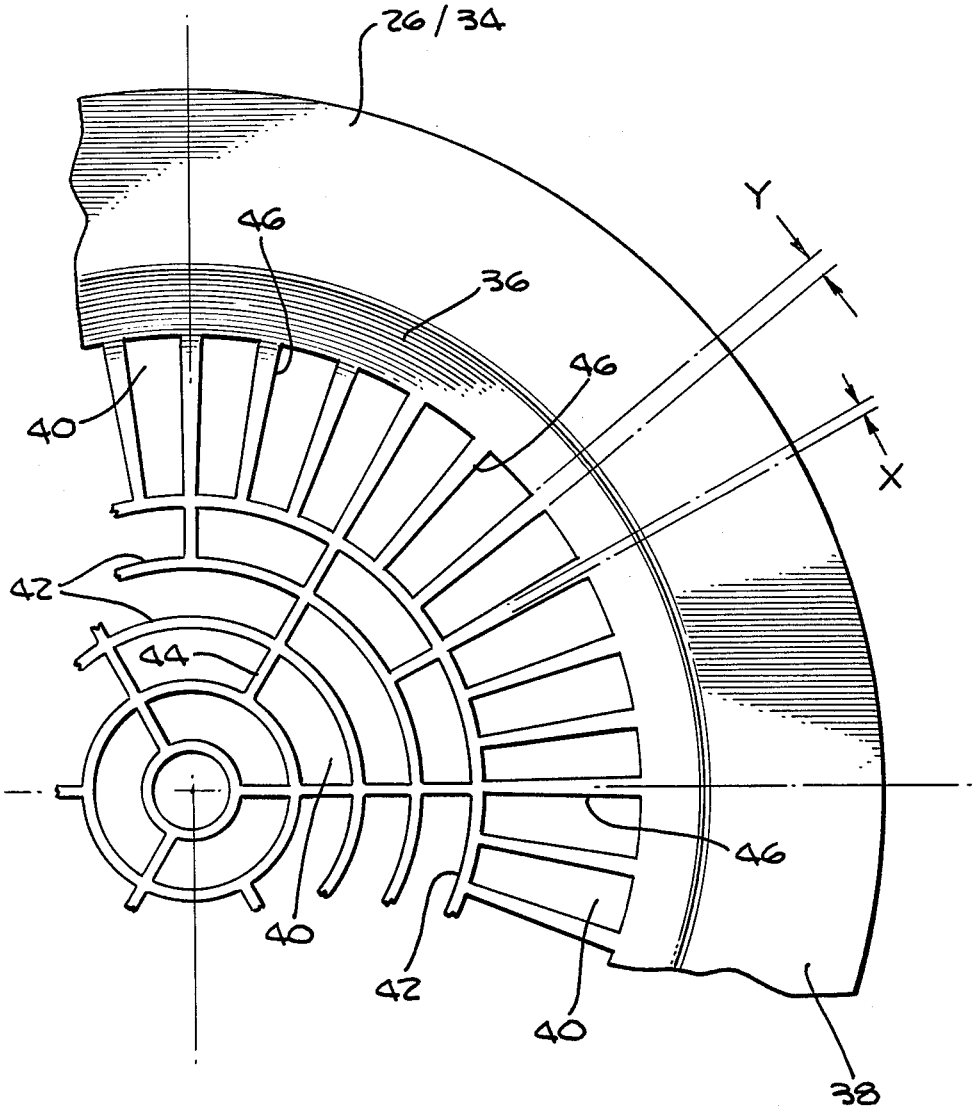
FIG. 3 is a quarter section of a grid shown in greater detail illustrating the improved grid configuration of the present invention.

Referring now to FIG. 3, a quarter-circular layout of a shadow/control grid 26/34 is shown incorporating the increased peripheral area of the present invention. In the preferred embodiment, the radial conductive elements or grid vanes 46 are tapered wherein the narrower width of the taper is located at an inner circular conductive element 42; while the wider outer width is located at the outer extreme of the cell 40. In the embodiment shown in FIG. 3, a typical shadow or control grid is shown wherein the narrow inner width "x" is shown approximately one-half as wide as the wider outer width "y". In the preferred embodiment, the shadow grid 26 has been designed with an inner width "x" of the grid vane 46 equal to 0.002 inches; while the wider outer width "y" is 0.004 inches. The control grid 34 is made larger than the shadow grid having an inner width "x" of 0.0035 inches, while the wider outer width "y" of grid vane 46 is 0.006 inches. The tapering grid vanes 46 form a unique arrangement within the shadow grid 26 and/or control grid 34 not found in prior art grids. Also, it is believed that the use of a control grid 34 having grid rings 42 and vanes 46 wider than the grid rings 42 and vanes 46 of the shadow grid 26 may be unique. Most prior art grid arrangements which incorporate a shadow grid have grid rings and vanes that are the same width or wider than the rings and vanes of the control grid.

In operation, electrons boiled from the smooth, concaved surface 18 of cathode 16 pass through the grids 26 and 34 and are accelerated toward an annular opening 48 in the anode 12, FIG. 1, to form a beam of electrons "b." This beam "b" may be terminated by applying a negative potential to the ring 32 and control grid 34, for example. In a typical electron gun embodying the prior art grid as shown in FIG. 2 having a constant cross section for the grid vanes 44, the cut-off voltage $V_{co}$ applied to control grid 34 is −165 volts. By utilizing the tapered grid vanes 46 of the present invention shown in FIG. 3, that same cut-off voltage $V_{co}$ may be reduced to −90 volts.

Experimentally, it was found that a typical electron gun utilizing the tapered grid vane 46 of the present invention would have the following parameters:

| PRIOR ART ELECTRON GUN | ELECTRON GUN WITH TAPERING VANES |
|---|---|
| $V_o$ = 11 kv | $V_o$ = 11 kv |
| $I_o$ = 1.6 a | $I_o$ = 1.6 a |
| $V_{co}$ = −165 v. | $V_{co}$ = −89.5 v. |
| $V_{op}$ = +153 v. | $V_{op}$ = +158 v. |
| BT = 95.8% | BT = 96.4% |

Wherein $V_o$ is the beam voltage, $I_o$ is the beam current, $V_{co}$ is the cut-off voltage applied to control grid 34 with respect to cathode 26, $V_{op}$ is the operating voltage applied to control grid 34 with respect to cathode 26, and BT is the beam transmission expressed as the percent of current reaching the collector, not shown, of the electron gun 10.

The foregoing values are achieved by applying a voltage of −11 kv to the cathode 16 and the shadow grid 26, while the anode 12 is held at ground potential. It has been found that the utilization of the tapered grid vanes 46 permits the electron beam "b" to be cut off or terminated by applying −89.5 volts to control grid 34 with respect to the cathode rather than −165 volts. While the cut-off voltage has been reduced by almost half, it is more important to note that the same cut-off voltage of −165 volts may be utilized. This permits the reduction of the number of grid wires or grid vanes 46 within the tapered vane control grid 34. Not only does the reduced number of grid vanes improved or lighten the loading of the cathode in terms of amps/sq.

but the reduced number of grid vanes improves the electron beam transmission to the collector from the electron gun 10 even further.

As seen in FIG. 3, the outer set of cells 40 are the only cells having the tapered grid vanes 46. It will be understood that other configurations may be used to provide a control or shadow grid with an increased surface area at its outer periphery. Further, the dimensions of the tapered grid vanes forming the shadow grid 26 and the control grid 36 are examples of the preferred embodiment and may be varied within the teachings of the present invention. Accordingly, the present invention should be limited only by the appended claims. We claim:

1. An improved gridded electron gun having an anode, a cathode, and at least one grid member mounted there between for controlling the flow of electrons from said cathode toward said anode, the improvement of said grid member comprising:

an outer periphery having a greater surface area than its inner regions;

a plurality of apertures separated by grid vanes, wherein said grid vanes taper from a narrow inner width toward a wider outer width making up said greater surface area.

2. An improved gridded electron gun as claimed in claim 1, wherein said at least one grid member comprises:

a shadow grid, mounted adjacent said cathode; and a control grid mounted between said shadow grid and said anode.

3. An improved gridded electron gun, as claimed in claim 1, wherein said at least one grid member comprises:

a shadow grid mounted adjacent said cathode having a plurality of apertures therein separated by grid rings and vanes; and said grid rings and/or vanes on said control grid being wider than said grid rings and/or vanes on said shadow grid.

4. A gridded electron gun, as claimed in claim 3, additionally comprising:

said grid vanes on said shadow grid taper from a narrow inner width to a wider outer width.

5. An improved electron gun having a cathode and an anode and control grid mounted there between for terminating the flow of electrons from said cathode to said anode when a biasing voltage is applied to said control grid, the improvement of said control grid comprising:

grid vanes having greater surface area at the outer periphery than the inner regions of said vanes which form said control grid wherein fewer grid vanes are required to terminate said flow of electrons when said bias voltage is applied thereto, for improved electron transmission.

6. A gridded electron gun, as claimed in claim 5, wherein said grid vanes taper from a narrow inner width toward a wider outer width.

7. A gridded electron gun as claimed in claim 6, wherein said grid additionally comprises:

a shadow grid mounted next to said cathode;

said control grid munted between said shadow grid and said anode; and said shadow grid also having tapered grid vanes.

8. A gridded electron gun as claimed in claim 7, wherein:

said grid vanes in said control grid are wider than said grid vanes in said shadow grid.

* * * * *